United States Patent [19]

Mack

[11] 4,173,921

[45] Nov. 13, 1979

[54] CARTON HOLD-DOWN APPARATUS

[75] Inventor: Halmer B. Mack, Aptos, Calif.

[73] Assignee: Goodale Manufacturing Company, Inc., Watsonvile, Calif.

[21] Appl. No.: 864,736

[22] Filed: Dec. 27, 1977

[51] Int. Cl.[2] ..... B31B 1/64

[52] U.S. Cl. ..... 93/36.3; 53/387

[58] Field of Search ..... 93/36.3, 46, 50; 53/387

[56] References Cited

U.S. PATENT DOCUMENTS

| | | | |
|---|---|---|---|
| 1,195,228 | 8/1916 | Johnson | 53/387 X |
| 1,482,197 | 1/1924 | Kimball | 53/387 X |
| 1,887,699 | 11/1932 | Reid | 53/387 |
| 2,805,533 | 9/1957 | Holstebroe | 53/387 |
| 3,183,639 | 5/1965 | Rodman | 53/75 |
| 3,523,398 | 8/1970 | Barnes | 93/36.3 UX |

*Primary Examiner*—James F. Coan

*Attorney, Agent, or Firm*—Gerald L. Moore

[57] ABSTRACT

Apparatus for holding the flaps of a carton to allow the glue to set and seal the flaps in the closed position. After glue has been applied and the flaps are folded to the closed position, there is a short time period that the flaps must be maintained closed by an external force. Because of the uneven contour of the flaps, the subject invention is provided to apply this force in a firm yet yieldable manner to allow for the uneven carton contours while not exerting unneeded force on the carton contents as it moves through the apparatus.

5 Claims, 6 Drawing Figures

CARTON HOLD-DOWN APPARATUS

BACKGROUND OF THE INVENTION

In the sealing of cardboard cartons the usual procedure is to place an adhesive or glue on the adjacent surfaces of the top flaps, fold the flaps to the closed position and hold the flaps in that position until the glue sets sufficiently to retain the flaps in that position. While there have been advances made in quick-acting glues, still the flaps must be held in the closed position by an external force for a period of time sufficient to allow the glue to set and retain the flaps.

Difficulties arise in holding the flaps because they do not always fold completely flat but are frequently higher in the middle than on the sides. In addition other irregularities in the configuration of the folded flaps can exist. For instance, depending upon how full the container is, the vertical spacing between the flaps and the carton bottom can change even between containers formed from the same size blanks due to the fullness of the carton, variations in the position of the bend of the flaps, et cetera. In addition if the contents of the container are at all fragile or can be deformed by the exertion of excessive force on the top, the amount of force exerted on the container top must be limited. Thus there is the need for such apparatus to function with more than one carton size to increase the usefulness and efficiency of the equipment.

It is the primary purpose of this invention to provide a carton hold-down apparatus of improved design and construction which will accommodate different carton sizes and effectively retain the flaps closed while the glue sets without interrupting the forward progress of the carton.

SUMMARY OF THE INVENTION

A carton hold-down apparatus comprising the combination of a conveyor for transporting the carton along a predetermined path beneath a top frame member supporting a plurality of flexible planar members extending laterally across the carton path in position to contact and be flexed by the carton top. The flexible members bend when contacted by the moving carton to exert a continuous downward pressure across the top of the carton and hold the top flaps in the closed position for a sufficient length of time for the glue to set. Irregularities in the carton top surface are accommodated by flexing of the members of the flexible member assembly. In addition the frame member holding the flexible member assembly is adjustable in height and is spring-loaded to yield and accomodate varying carton heights.

DESCRIPTION OF THE INVENTION

Figures 1, 2:
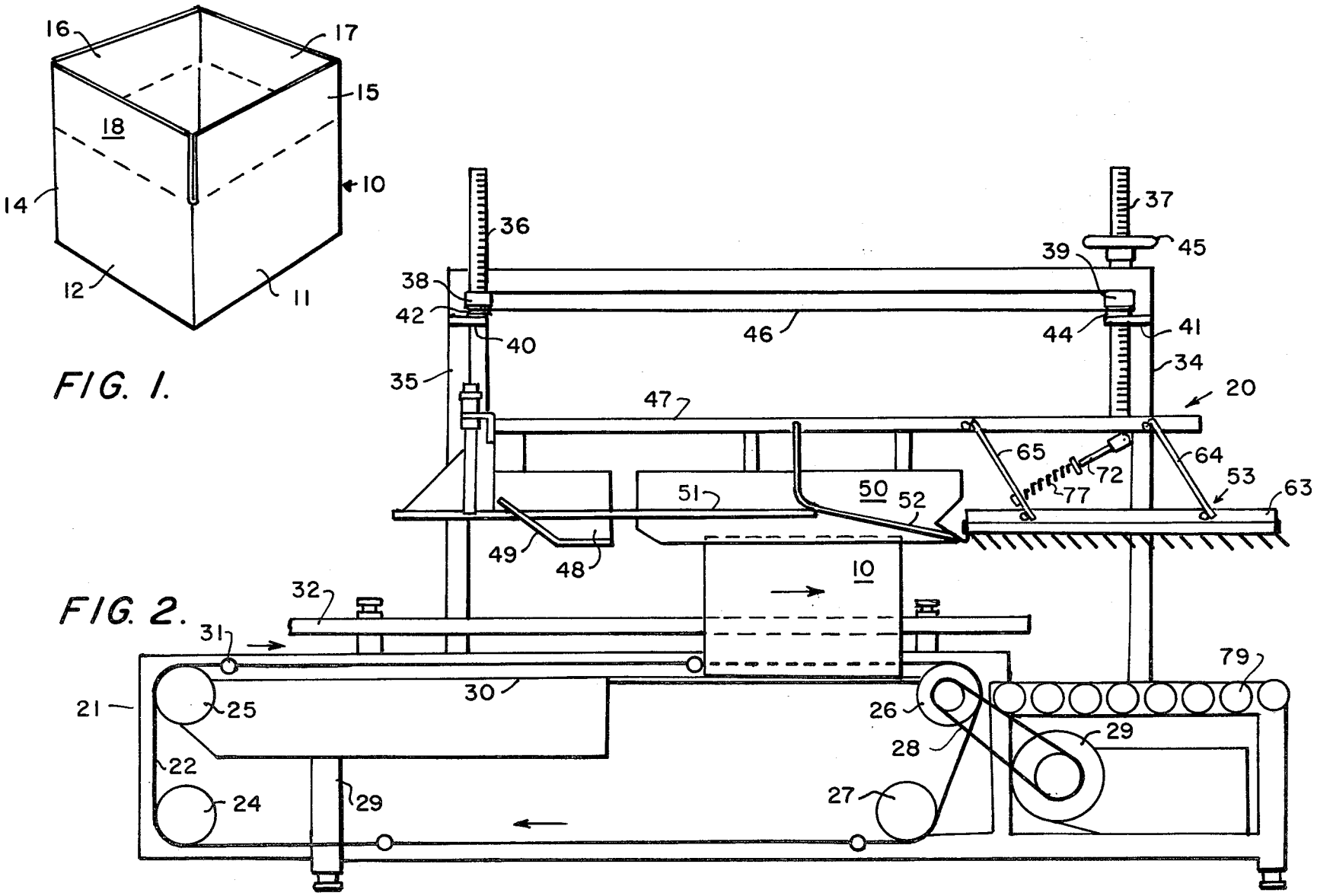
FIG. 1 is a perspective view of a carton of the type which can be sealed by the subject invention.
FIG. 2 is an overall side view of the carton hold-down apparatus incorporating the subject invention.

The subject invention is primarily designed for the purpose of holding the top flaps closed on a carton such as that shown in FIG. 1 while the glue sets to seal the flaps in the closed position. Therein is shown a carton 10 comprising a front panel 11, a pair of side panels 12 and a rear panel 14. After such a carton has been filled it is necessary to close the top usually by first folding down the front top panel 15 and the rear top panel 16, thereafter the side top panels 17 and 18. Glue is placed on one or all of the adjacent flap surfaces before folding them down flat. If the glue (not shown) being used is a cold spray type, a few seconds may be necessary for it to set sufficiently to hold the flaps closed. Even if the glue is a quick-setting hot melt type, it still takes a short time to adhere sufficiently to hold the top panels in the closed position. Thus a downward force must continually be exerted on these top panels after being folded since the natural tendency of these top panels is to spring upwards towards the open position.

Figure 6:
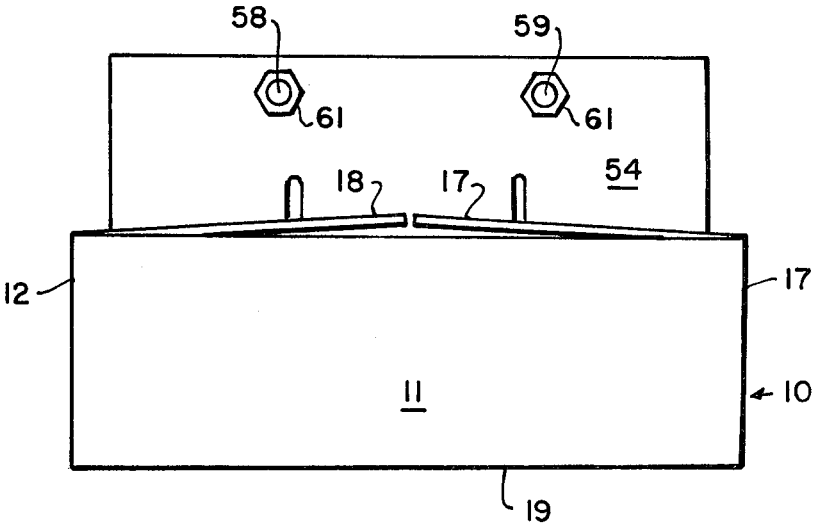
FIG. 6 is an end view of a carton as it passes under the flexible member assembly.

This tendency of these flaps to open is also increased if the carton is full. For instance, as shown in FIG. 6, the carton 10 has been filled such that after folding, the side top flaps 17 and 18 do not lie exactly in a position parallel to the carton bottom surface 19. Even if the carton is not full these flaps tend to open to the position shown because of the resistance to bending of the cardboard material utilized.

In accordance with the present invention, there is provided an apparatus 20 (FIGS. 2 and 3) for receiving the carton with the top flaps folded down and for holding these flaps in the closed position a sufficient length of time to allow the glue to set and seal the carton closed. Accordingly as shown in FIG. 1, there is provided a conveyor 21 comprising a pair of spaced endless belts 22 positioned around the rollers 24, 25, 26 and 27 to each side of a platform 30. The roller 26 is power driven by a drive belt 28 extending from a drive motor 29. Thus the conveyor belts are driven in the clockwise direction and support therebetween a plurality of push bars 31 which move the cartons 10 along a predetermined path from left to right in the drawing of FIG. 1.

The conveyor apparatus is supported on the vertically extending legs 29 supporting the platform 30 along which the cartons slide as they are pushed by the conveyor supported bars 31. Fenders 32 positioned to each side of the carton path maintain the carton on line. Prior to receipt of the carton 10 on the platform 30, the front and rear top panels 15 and 16 have been folded downward and the side top panels 17 and 18 have been folded over these front and rear panels. Glue has previously been deposited on the abutting surfaces of these flaps. The carton must be held with these panels in this closed or folded position until the glue thereon adheres sufficiently to hold the carton closed.

Figure 3:
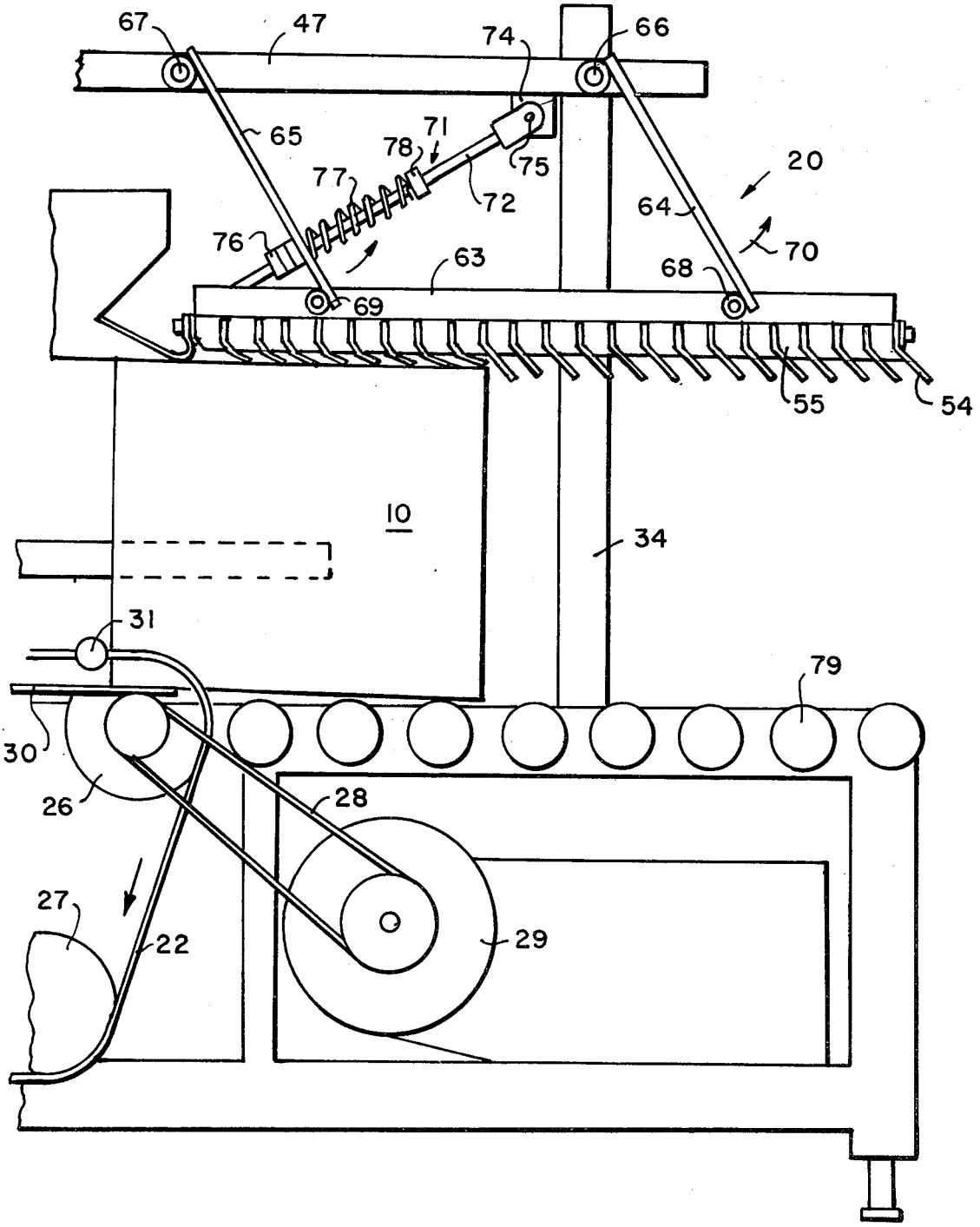
FIG. 3 is an enlarged side view of the hold-down apparatus.
Figure 4:
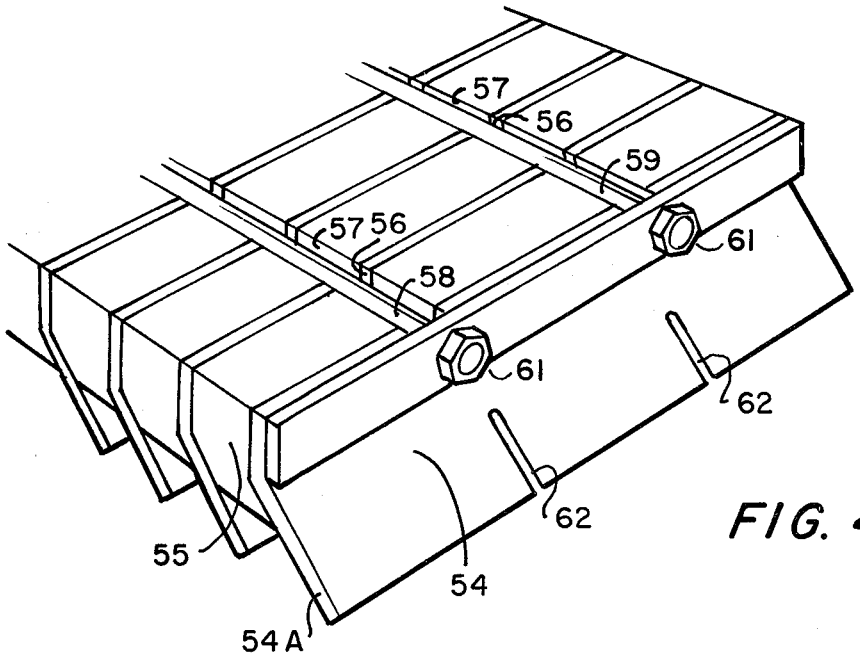
FIG. 4 is an enlarged perspective view of the flexible member assembly for exerting the downward pressure on the carton top.
Figure 5:
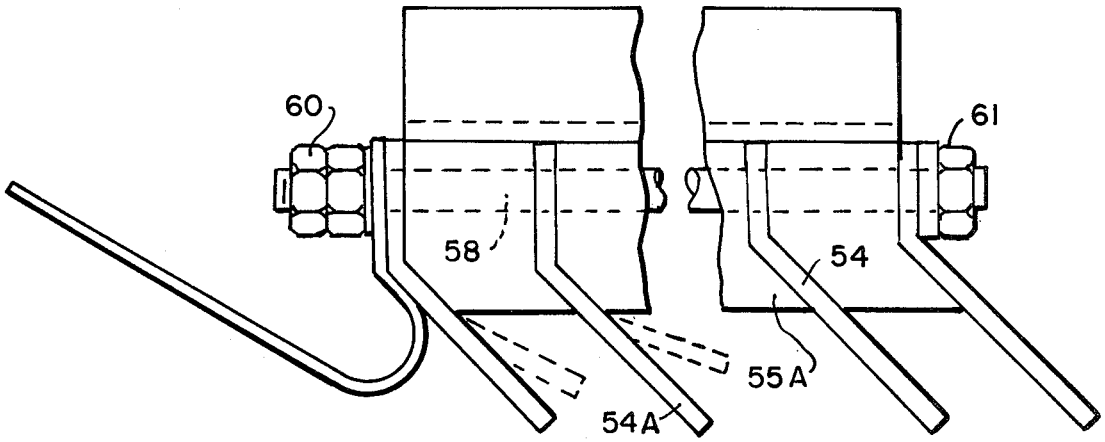
FIG. 5 is an enlarged cross-sectional view of a portion of the flexible member assembly showing the flexible members.

As shown in FIGS. 2 and 3, there is positioned above the carton path and the platform 30 a top frame 33 mounted on the plurality of upright members 34 and 35. The top frame includes a pair of vertical support members 36 and 37 which are threaded into rotatable nuts 38 and 39 resting on the flanges 40 and 41 respectively and fixed to the top frame. Also fixed to these nuts are pulleys 42 and 44. A hand wheel 45 is attached to the pulley 44 and a cable 46 connects all the pulleys. As can be seen in FIG. 2, turning of the hand wheel 45 will rotate the nuts 38 and 39 by the rotation of the pulleys 42 and 44 to shift the threaded support members 36 and 37 vertically relative to the top frame.

Fixed to the lower end of these vertical support members 36 and 37 is a horizontally extending frame 47. This horizontal frame supports the hold-down assembly which contacts the carton top and holds the top panels in the closed position for a sufficient time to allow the glue to set. For this purpose there is provided a front fender 48 having a beveled leading edge 49 which exerts a downward pressure on the front and rear panels to force the panels 15 and 16 inward to a horizontal position. Thereafter a top fender 50 further holds these panels 15 and 16 downward. Panels 17 and 18 are folded inward by a bar guide 51 and guided further to a fully closed position by bar guide 52 just prior to entering hold-down area 53. By sliding the carton forward on the surface 30, the downward force serves to squeeze the carton between this surface and the fenders.

Adjacent these fenders is the flexible member assembly 53 which contacts each carton as it passes from the support table 30 onto the plurality of rotatable rollers 54 positioned side-by-side and extending laterally across the path of the carton. The purpose of the flexible member assembly is to continue the downward force on the carton top panels to allow the glue to set as the carton proceeds forward. Because the top of the carton frequently is domed or not planar in the manner shown in FIG. 6, it is necessary for the hold-down assembly to be able to accommodate various carton top contours while exerting the necessary force across the carton to hold the top panels closed. For this purpose the hold-down assembly 53 comprises a plurality of planar members 55 (see FIGS. 2 through 6) which are made of a flexible belt-like material which preferably is coated with a slick coating such as rubber so as to present a low coefficient of friction with the carton top.

For holding these flexible members in position, there is sandwiched between each adjacent flexible member 54 a spacer 55. The flexible members and spacers each include top slots 56 and 57 respectively, through which can be passed bolts 58 and 59. Nuts 60 and 61 threaded onto the bolts squeeze the flexible members and spacers together so as to form a rigid assembly from which the lower ends 54A of the flexible members (FIG. 5) extend. The spacers each include an offset portion 55A which presses against the adjacent flexible member to cause the end 54A to extend downward and in the direction of travel of the carton. These extending ends 54A also include a plurality of slots 62, the purpose of which will be explained later.

The flexible member assembly is supported on the horizontal frame member 47 by a plurality of pivot arms 64 and 65 pivotally fixed to the horizontal frame member by the bolts 66 and 67, and to the angle bracket 63 on the flexible member assembly by the bolts 68 and 69, respectively. Thus these arms can be pivoted primarily in the counterclockwise direction as illustrated by the arrow 70 to allow raising of the flexible member assembly. The assembly is maintained in a position with the pivot arms extending downward and in the direction of travel of the carton by a spring and arm assembly 71 comprising an arm 72 pivotally fixed to a bracket 74 by a pin 75 passing therethrough. The opposite end of the arm 72 is threaded to receive a nut 76 after passage through an opening (not shown) in the pivot arm 65. A coil spring 77 is positioned about the arm 72 between the pivot arm 65 and a nut 78 also threaded on the arm. By turning either of the nuts 76 or 78 the compression force on the spring can be increased or decreased to adjust the resistance to pivotal movement of the flexible member assembly.

To explain the overall operation of the hold-down apparatus, the carton 10 is received on the platform 30 and pushed therealong by the push bars 31. The fender 48 first contacts and exerts a downward pressure on the top inside panels 15 and 16 followed by continued downward pressure by the fender 50. Thereafter the outside panels 17 and 18 are folded inward by the bar guides 51 and 52. The carton then passes onto the rollers 79 and the flexible fingers 54 contact the top surface of the carton to continue the holding of the top panels in the closed position and stationary relative to each other until the glue sets. Subsequently the carton passes from the apparatus with the glue set sufficiently to secure the top panels in the closed position.

Thus the top flaps are held in the folded or closed position as the carton proceeds uninterruptedly along the conveyor path. The pressure exerted by the flexible arm assembly is substantially uniform across the carton top surface. With changes in the contour of the carton top surface, the flexible members will bend to accommodate the carton top surface. The slots 62 in the flexible members facilitate such bending. In addition, if it is desired to hold the carton top surface closed for a longer time period, additional flexible member assemblies can be added downstream of the first assembly.

The invention claimed is:

1. An apparatus for exerting pressure on a container comprising in combination:

a conveyor for moving the container along a predetermined path;

a frame positioned above said predetermined path; and a plurality of flexible planar members supported on said frame and extending downward and across said predetermined path so as to contact a substantial portion of the top surface of the container and exert pressure thereon while flexing as the container is moved along the conveyor.

2. Apparatus as defined in claim 1 wherein said flexible planar members are supported in a manner to extend downward and in the direction of movement of the container.

3. Apparatus as defined in claim 2 wherein said flexible members extend in a direction normal to the predetermined path for the container.

4. Apparatus as defined in claim 3 wherein said frame is supported for movement upward with contact by the container so as to accommodate different size containers.

5. Apparatus as defined in claim 4 including spring means for biasing said frame member downward towards the container predetermined path.

* * * * *